US008344993B2

(12) United States Patent
Kanechika et al.

(10) Patent No.: US 8,344,993 B2
(45) Date of Patent: Jan. 1, 2013

(54) BACKLIGHT DEVICE AND METHOD FOR LCD DISPLAYS

(75) Inventors: Masayuki Kanechika, Tokyo (JP); Junji Matsuda, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 1059 days.

(21) Appl. No.: 11/837,203

(22) Filed: Aug. 10, 2007

(65) Prior Publication Data

US 2008/0042596 A1 Feb. 21, 2008

(30) Foreign Application Priority Data

Aug. 16, 2006 (JP) ..... 2006-221958
Apr. 12, 2007 (JP) ..... 2007-104705

(51) Int. Cl.
*H05B 41/36* (2006.01)

(52) U.S. Cl. ..... 345/102

(58) Field of Classification Search ..... 345/102, 345/171, 173; 315/159, 291, 308
See application file for complete search history.

(56) References Cited

U.S. PATENT DOCUMENTS

2005/0212460 A1* 9/2005 Liao et al. ..... 315/291
2005/0258783 A1* 11/2005 Honbo ..... 315/308
2006/0238128 A1* 10/2006 Chen ..... 313/635
2007/0075649 A1* 4/2007 Yamashita et al. ..... 315/159

FOREIGN PATENT DOCUMENTS

JP 06-037382 A * 9/1995
JP 2002050498 2/2002

* cited by examiner

*Primary Examiner* — Quan-Zhen Wang
*Assistant Examiner* — Tony Davis
(74) *Attorney, Agent, or Firm* — Kenealy Vaidya LLP

(57) ABSTRACT

A backlight device for LCD displays can include a light-emitting source of the type that includes a cold-cathode or hot-cathode fluorescent tube that is lit with a high-frequency power supply. The high-frequency power supply can be PWM-controlled to adjust the brightness. The high-frequency power supply can also be randomly phase-modulated with an irregular modulation code to light the fluorescent tube. This enables the infrared radiation from the fluorescent tube to be spread over a wider band such that the level thereof is lowered to a level that does not interfere with typical remote controls.

10 Claims, 5 Drawing Sheets

BACKLIGHT DEVICE AND METHOD FOR LCD DISPLAYS

This application claims the priority benefit under 35 U.S.C. §119 of Japanese Patent Application No. 2006-221958 filed on Aug. 16, 2006, and Japanese Patent Application No. 2007-104705, filed on Apr. 12, 2007, both of which are hereby incorporated in their entireties by reference.

BACKGROUND

1. Field

The disclosed subject matter relates to a TV receiver called an LCD TV that can include an LED-based display, or a personal computer that can receive and record TV programs and can include a large LED-based display called a monitor, and more particularly to a backlight device for illuminating LCD displays from behind.

2. Description of the Related Art

An example of a conventional backlight device 90 for an LCD panel 80 is shown in FIG. 6. The backlight device 90 is operative to light two cold-cathode tubes 81, 82 provided on the LCD panel 80.

The cold-cathode tubes 81, 82 are connected to lighting circuits 91, 92 each composed of an inverter that applies a high voltage of, for example, a high frequency (several 10 kHz) for lighting. The lighting circuits 91, 92 are connected to a power circuit 83 for supplying power thereto.

The lighting circuits 91, 92 are also connected to a dimming controller 93, which provides the lighting circuits 91, 92 with dimming signals C1, C2 of several 100 Hz and with an appropriate duty ratio. The lighting circuits 91, 92 turn on the tubes when the dimming signal is at "H" level and turn off the tubes when the dimming signal is at "L" level. Thus, the duty ratio of the dimming signals C1, C2 can be varied to adjust the brightness of the LCD panel 80.

The LCD panel 80 is connected to a driver 84 that receives an image signal for displaying an image on the LCD panel 80 and drives the LCD panel 80. In addition, when no image signal is supplied, the driver halts the lighting circuits 91, 92 via the dimming controller 93 for saving power.

FIG. 7 shows the following: dimming signals C1, C2 that are output when the LCD panel 80 is driven; an output i1 from the cold-cathode tube 81 that lights in response to the dimming signal C1; an output i2 from the cold-cathode tube 82 that lights in response to the dimming signal C2; and a synthesized output (i1+i2) from both the cold-cathode tubes 81, 82. Driving the lighting circuits 91, 92 in this way makes it possible to keep the maximum of current flowing in the power circuit 83 unchanged while allowing the brightness of the screen to be changed. (For example, see Japanese Patent Document 1: JP-A 2002-50498).

In the above-described related art dimming system, a high frequency of 55-100 kHz for lighting is first applied to the cold-cathode tubes 81, 82. In addition, the dimming controller 93 performs PWM modulation for adjusting the brightness of the screen. When this method is used for dimming control, as schematically shown in FIG. 8, the energy corresponding to the sine wave of the high-frequency drive voltage for lighting can be spread to lower the peak value on the curve P to that on the curve Q as shown. This is an effective measure against electromagnetic radiation noises.

This method, however, disperses the infrared frequency components radiated from the cold-cathode fluorescent tube (CCFL) or the hot-cathode fluorescent tube (HCFL). In this case, the infrared frequency components are spread into the frequency range used by infrared remote controls that are used in video recording instruments such as TV receivers, video recorders and DVD drives to send data at frequencies near 38 kHz (see FIG. 3B). As a result, an adverse effect may be exerted on operation of the infrared remote control and, in an extreme case, a malfunction may occur in the infrared remote control.

SUMMARY

In accordance with an aspect of the disclosed subject matter, a backlight device for LCD displays can be provided that includes a light-emitting source of the type that includes a cold-cathode or hot-cathode fluorescent tube lit with a high-frequency power supply and in which the high-frequency power supply is PWM-controlled to adjust the brightness, wherein high-frequency energy from the high-frequency power supply is spread over a wide band along the frequency axis such that PWM-modulated infrared energy generated from the backlight device for LCD displays is not concentrated at a specific frequency, but spread over a wide band.

When brightness of the screen is adjusted while lighting a backlight device that includes a cold-cathode or hot-cathode fluorescent discharge tube used as the light source, previously, the lighting voltage was randomly phase-modulated or frequency-hopped. As a result, the level of infrared output from the fluorescent discharge tube can be lowered within a frequency band for use in infrared remote controls. Thus, it is possible to suffer less influence and exert an excellent effect to achieve stable operation.

DETAILED DESCRIPTION OF EXEMPLARY EMBODIMENTS

Figure 1:
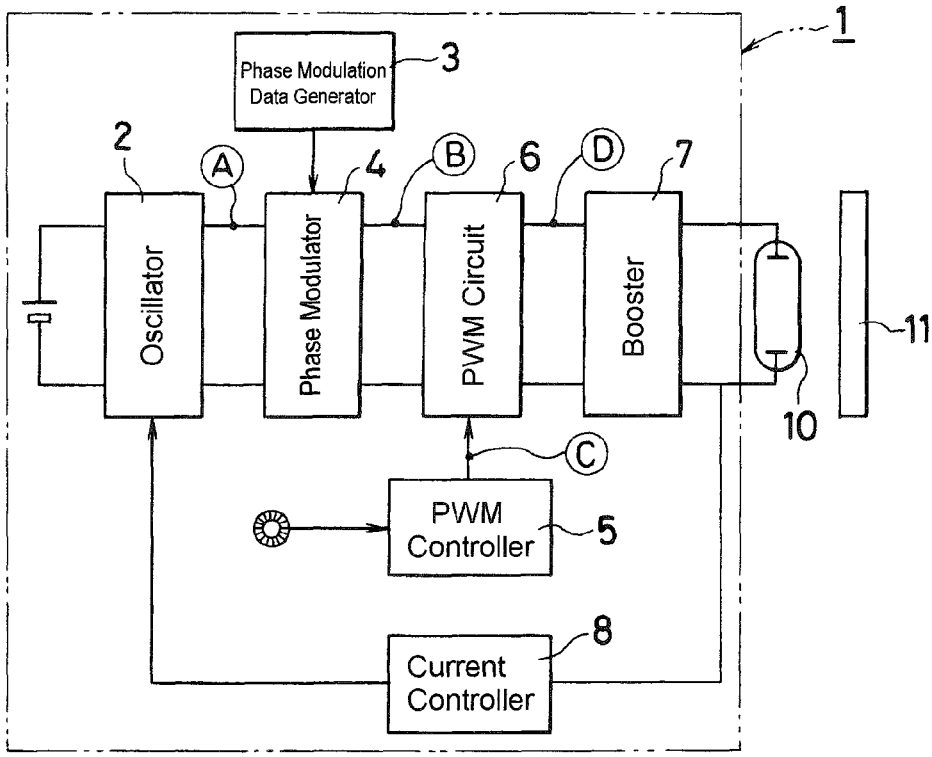
FIG. 1 is a block diagram showing a configuration of an embodiment of a backlight device made in accordance with principles of the disclosed subject matter.

The presently disclosed subject matter will now be described in detail based on certain exemplary embodiments shown in the above-referenced figures. The block diagram shown in FIG. 1 is directed to a backlight device 1 for LCD displays made in accordance with principles of the presently disclosed subject matter (hereinafter referred to as the backlight device 1). This backlight device 1 is configured to light a cold-cathode or hot-cathode fluorescent discharge tube 10 to illuminate an LCD display 11 from behind.

Recently, the market has been introduced to personal computers that also serve as TV receivers and comprise an LCD display 11 as large as a 37-inch LCD display, for example, which naturally includes a large number of fluorescent discharge tubes 10. The personal computer often includes an infrared remote control (not shown). Therefore, the LCD display 11 as shown in FIG. 1 can be effectively used.

Turning to a description of the configuration of the backlight device 1, the backlight device 1 can be provided with an oscillator 2 as a first circuit that oscillates at 55-100 kHz for lighting the fluorescent discharge tube 10.

The oscillator 2 can be connected to a phase modulator 4 that modulates the phase of a high frequency voltage that is oscillated as a sine wave of 55 kHz, for example, based on a signal from a phase-modulation data generator 3.

As described above, the high-frequency voltage that is oscillated at the oscillator 2 and phase-modulated at the phase modulator 4 is fed to a PWM circuit 6 with a PWM (Pulse Width Modulation) controller 5 attached thereto and converted to have a duty width that achieves viewer-preferred brightness. Finally, the voltage is boosted at a booster 7 that can be configured as an inverter, up to a sufficient voltage to light the fluorescent discharge tube 10. A current controller 8 can be connected between the output of the booster 7 and the oscillator 2 to monitor the current flowing in the fluorescent discharge tube 10 and handle the fluctuation of the input voltage.

In this case, the phase-modulation data generator 3 is designed to provide an "irregular modulation code" with less regularity and can be programmed to generate a pseudo noise (PN) that prevents concentration of energy at a specific frequency. On pre-production, no commercially available items were uncovered that include phase modulators that works at a low frequency corresponding to the lighting frequency of the fluorescent discharge tube 10. Therefore, an integrated chip (IC) that is capable of providing a phase shifter function can be used for phase modulation. (An example of such a device is part number AD 8333 available from ANALOG DEVICES, Inc.)

The thus modulated high-frequency drive voltage can be used to light the fluorescent discharge tube 10. In this case, the infrared frequency components that are modulated are obviously lower than those that are not phase-modulated and do not affect the remote control operation. This is because, when the PWM modulation signal is ON, the phase of the high-frequency drive voltage is not always constant, and the energy components at infrared frequencies from the fluorescent discharge tube 10 are spread near the noise level.

If the variations in phase of the high-frequency drive voltage when the PWM modulation signal is ON are repeated equally for every PWM modulation signal, energy concentrates at a specific frequency and a desired effect may not be achieved. Therefore, random variations in phase should be caused when the PWM modulation signal is ON.

Figure 2:
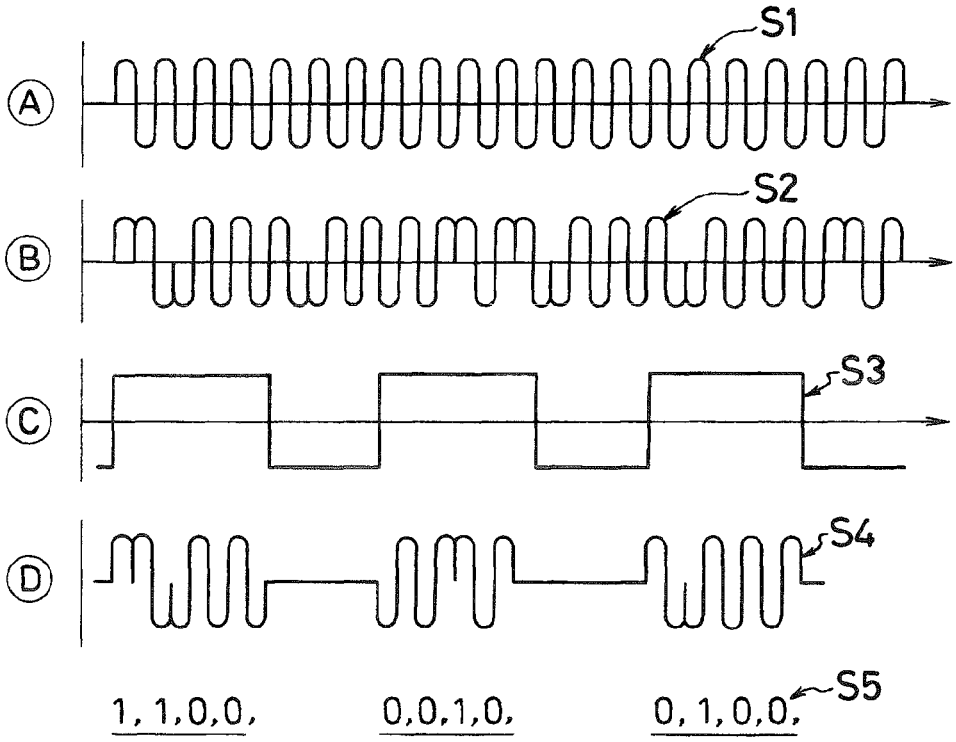
FIG. 2 shows graphs of waveforms at various nodes in the embodiment of FIG. 1.

FIG. 2 sequentially shows waveforms at various nodes A-D as denoted with reference symbols in the backlight device 1 shown in FIG. 1. First, the output from the oscillator 2, denoted with the reference symbol A, is shown as output signal S1 that is a sine wave of 55-100 kHz.

The output from the phase modulator 4, denoted with the reference symbol B, is shown as output signal S2 that is phase-modulated in accordance with the output from the phase-modulation data generator 3. In this case, variations in phase can be achieved through modulation by use of an irregular modulation code with less regularity to provide an output having a so-called random phase characteristic.

The output from the phase modulator 4 is fed to the PWM circuit 6, which is controlled with a signal S3 received from the PWM controller 5 that is used by the viewer to set the screen brightness as a duty ratio. The PWM circuit converts the output into an intermittent signal S4 in accordance with the duty ratio. The intermittent signal is then fed to the booster 7 and boosted up to a sufficient voltage to light the fluorescent discharge tube 10. In this case, the booster 7 exerts little or no influence on the signal shape and allows the fluorescent discharge tube 10 to be lit in response to the phase state of the signal S4 as it is.

The signal S2 output from the phase modulator 4 is encoded and shown as a signal S5. For convenience of description, in this example, a waveform that is not phase-modulated is indicated with "0" and a waveform that is phase-modulated is indicated with "1". In addition, the following description is given on the assumption that an on-region in one duty cycle includes 4 cycles.

In the above condition, one on-region can be configured in 16 combinations of [0, 0, 0, 0] through [1, 1, 1, 1]. In addition, the sorting of the 16 combinations can yield further variegated combinations. Accordingly, the phase-modulation data generator 3 selects an arrangement order for achieving a wider infrared spread among the above combinations and supplies it to the phase modulator 4 to obtain the so-called PN (Pseudo Noise).

Figure 3A:
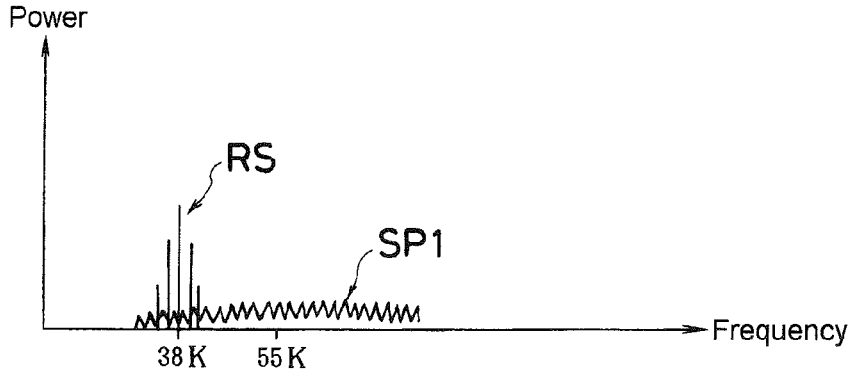
FIGS. 3A and B show graphs of radiated states of infrared radiation from the backlight device according to the presently disclosed subject matter in comparison with the related art.
Figure 3B:
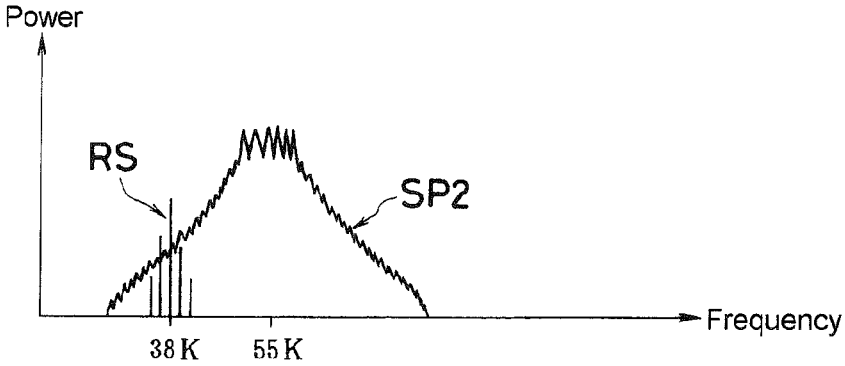

FIG. 3A shows a spread state SP1 of infrared radiation when the fluorescent discharge tube 10 is lit after an appropriate duty ratio is set by the viewer using the phase-modulated waveform as described above. FIG. 3B shows, for comparison, a spread state SP2 of infrared radiation when the fluorescent discharge tube 10 is lit after the same duty ratio as above and using only a sine waveform that is not phase-modulated.

After the phase modulation, the intensity level of infrared radiation from the fluorescent discharge tube 10 present in the remote control frequency band obviously lowers as shown in the graph in FIG. 3A. In this case, the intensity level does not reach the level that would exert an influence on an infrared remote control signal RS present in the proximity of the original 38 kHz.

In contrast, the graph shown in FIG. 3B shows the spread state SP2 of infrared radiation when the fluorescent discharge tube 10 is lit after the same duty ratio as described above and using the sine waveform oscillated at the oscillator 2. In this case, a large amount of infrared radiation having a fundamental harmonic component of 55 kHz oscillated at the oscillator 2 resides at and almost reaches the same level as the infrared remote control signal RS. Therefore, it can be understood that such a level as is sometimes present in the related art is expected to cause an erroneous operation or malfunction of the remote control.

The graph of FIG. 3A and the graph of FIG. 3B show results of measurements taken at a photoreceptor unit of an infrared remote control that was actually used. The band of infrared radiation radiated from the fluorescent discharge tube 10 is shown to be almost identical. It is, however, considered that the characteristic of a photodetector used in the photoreceptor unit restricts the receivable band. In practice, the spread band of infrared radiation from the fluorescent discharge tube 10 in FIG. 3A is believed to extend to a wider range by the extent of the lowered level.

Figure 4:
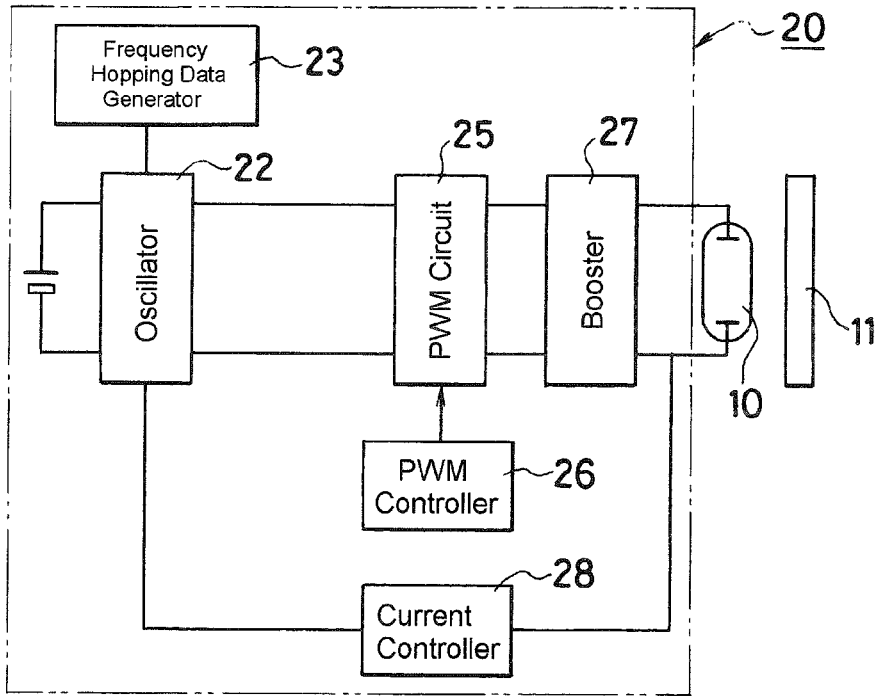
FIG. 4 is a block diagram showing a configuration of another embodiment of a backlight device made in accordance with the principles of the presently disclosed subject matter.

The block diagram shown in FIG. 4 shows another embodiment of a backlight device 20 made in accordance with principles of the disclosed subject matter. In the previous embodiment, the voltage applied to the device is phase-modulated to spread the spectral distribution of infrared radiation radiated from the fluorescent discharge tube 10. This is effective because the substantial voltage level is controlled so as not to substantially affect the infrared remote control signal RS. In contrast, in the embodiment of FIG. 4, frequency hopping spread spectrum can be applied to achieve substantially the same operation and effect as the embodiment of FIG. 1.

In FIG. 4, the backlight device 20 includes an oscillator 22, which is connected to a frequency hopping data generator 23. The frequency hopping data generator 23 is set to apply a voltage ranging from 0 V to 5 V at a step of 0.3125 V in 16 stages randomly to the oscillator 22 as shown on curve S21 in FIG. 5A.

Figures 5A, 5B, 5C, 5D:
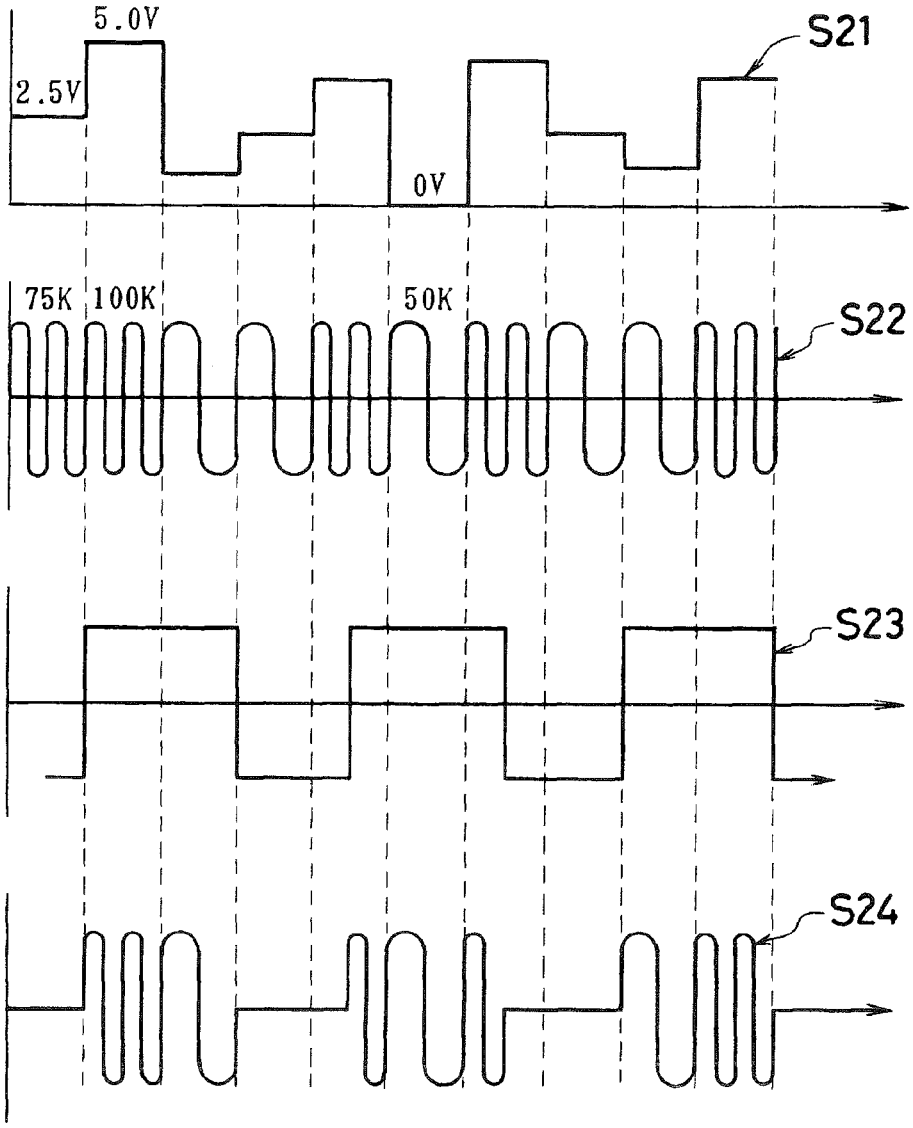
FIGS. 5A-D show graphs of waveforms at various points for the embodiment of FIG. 4.
Figure 6:
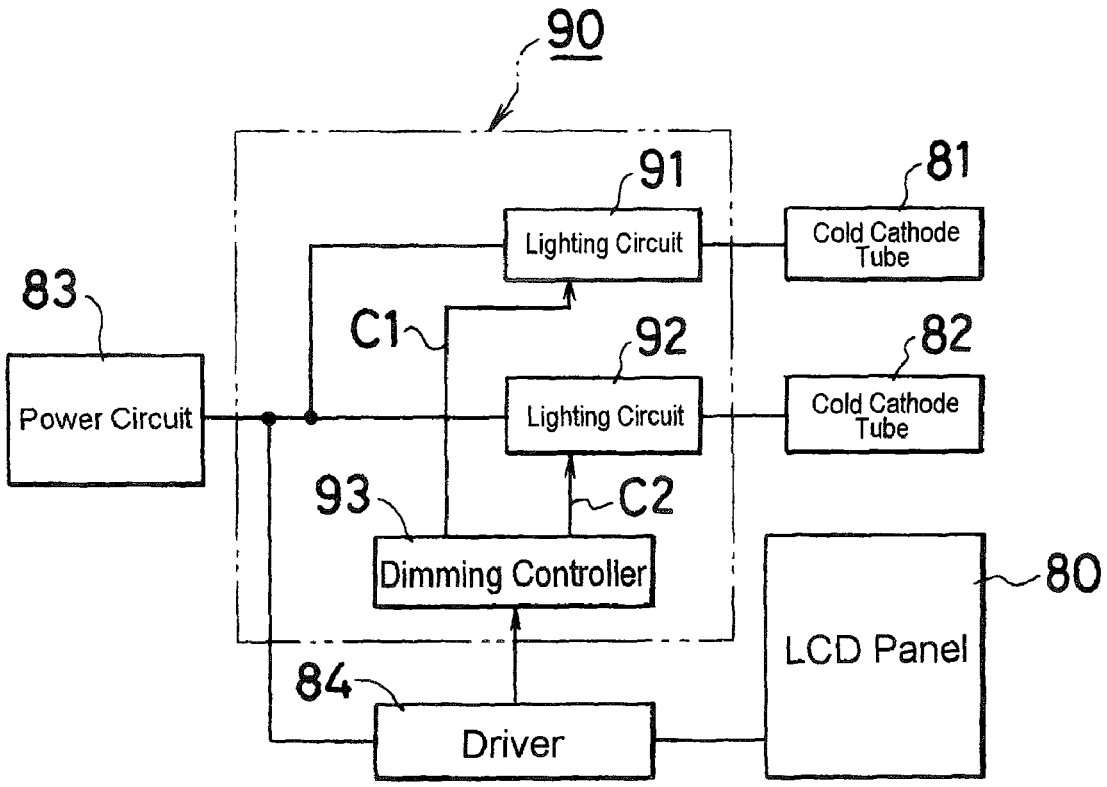
FIG. 6 CONVENTIONAL ART
FIG. 6 is a block diagram showing a configuration of a related art backlight device.
Figure 7:
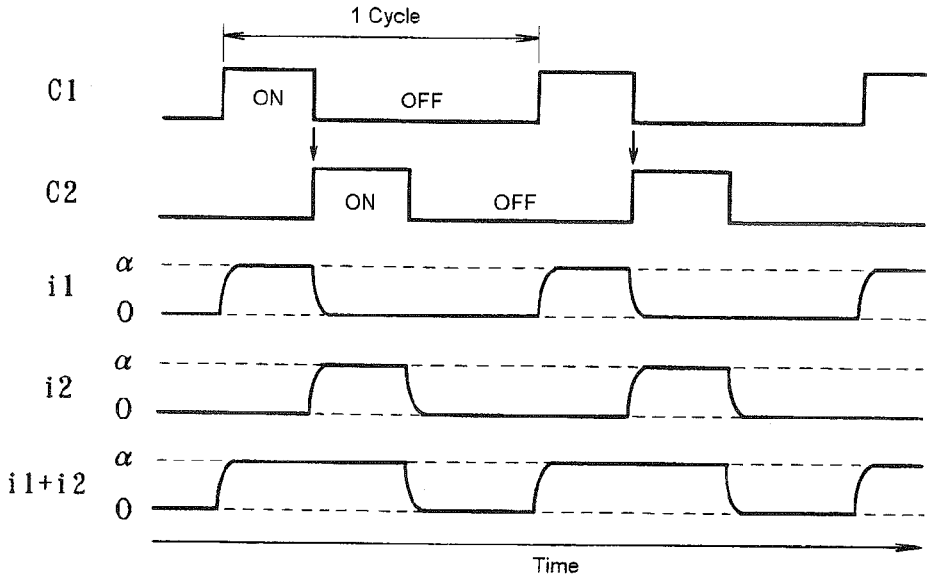
FIG. 7 CONVENTIONAL ART
FIG. 7 shows graphs of waveforms at various nodes in the related art backlight device of FIG. 6.
Figure 8:
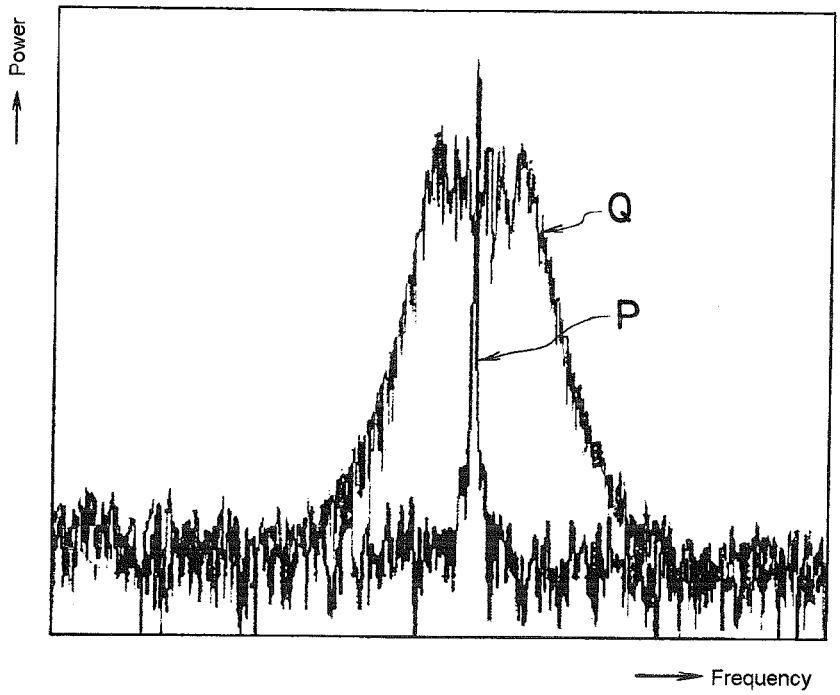
FIG. 8 CONVENTIONAL ART
FIG. 8 is an illustrative view schematically showing a radiated state of infrared from the backlight device of FIG. 6 when PWM-modulated.

The oscillator 22 sends a 50 kHz signal in response to the input of 0 V; 75 kHz in response to the input of 2.5 V; and 100 kHz in response to the input of 5 V from the frequency hopping data generator 23 as shown on a curve S22 in FIG. 5B. In this way, the oscillator 22 can send a frequency in accordance with the voltage applied thereto from the frequency hopping data generator 23.

The oscillator 22 varies the sending frequency in response to the signal from the frequency hopping data generator 23 while it executes continuous sending. Accordingly, the fluorescent discharge tube 10 lights at the maximum brightness and the LCD display 11 also illuminates at the maximum brightness.

Therefore, the consumer uses a PWM controller 26 to adjust the duty ratio to achieve a preferred brightness as shown on curve S23 in FIG. 5C. As a result, a PWM circuit 25 turns on/off the fluorescent discharge tube 10 as shown on curve S24 in FIG. 5D to set a preferred brightness of the screen. To facilitate creation of the drawing, FIG. 5 shows 75 kHz or higher as a short wave, and 75 kHz or lower as a long wave. In practice, though, 16 types of wavelengths are contained as described above and shown in the figure.

The reference numeral 27 denotes a booster that boosts the output from the PWM circuit 25, which may not have sufficient power in practice to light the fluorescent discharge tube 10, up to a voltage capable of lighting it. Also in the embodiment of FIG. 4, it is possible to prevent interference with the infrared remote control signal (as shown in FIG. 3A).

As described above, the phase conversion or random frequency variation per cycle of the sine wave that is produced at the oscillator 2 can be set such that the combination of phases or frequencies is randomized to provide a lighting power source for the fluorescent discharge tube 10. The fluorescent discharge tube 10 can be used with the LCD display 11, which is contained in the backlight device 1 for a TV receiver, computer screen, or the like. In this case, infrared radiation radiated from the fluorescent discharge tube 10 spreads over a wider frequency band and lowers the level to the extent that exerts little or no influence on the remote control frequencies, thereby preventing an erroneous operation even if the infrared radiation overlaps the frequency band used for infrared remote controls.

Thus, the backlight device 1 can prevent infrared remote controls using the same infrared radiation from erroneously operating. The infrared radiation from the fluorescent discharge tube 10 is subjected to phase modulation not for the purpose of communications as phase modulation is used in mobile phones, for example. Accordingly, there is no need after modulation for receiving the infrared again for demodulation. Therefore, a quite random modulation may be sufficient if it can lower the level of focused infrared radiation.

While there has been described what are at present considered to be exemplary embodiments of the present invention, it will be understood that various modifications may be made thereto, and that other embodiments of the invention exist, and that it is intended that the appended claims cover such modifications as fall within the true spirit and scope of the presently disclosed invention.

What is claimed is:

1. A backlight device for a liquid crystal display (LCD), said backlight device comprising:

a power supply generating device configured to generate a high frequency power supply; and a light-emitting source that includes at least one of a cold-cathode and a hot-cathode fluorescent tube that utilizes the high-frequency power supply from the power supply generating device;

wherein the power supply generating device includes, a pulse width modulation (PWM) controller configured to generate a PWM control signal; and a modulating device configured to receive the PWM control signal to generate a PWM-modulated high frequency voltage to adjust a brightness of the light-emitting source, the modulating device including a frequency hopping data generator configured to generate a pseudo-randomly changed voltage, and an oscillator configured to generate a high frequency voltage having frequencies pseudo-randomly changed by the pseudo-randomly changed voltage from the frequency hopping data generator to light at least one of the cold-cathode and the hot-cathode fluorescent tube.

2. The backlight device according to claim 1, wherein the modulating device includes a pseudo-random data generating device configured to generate a pseudo-random data to light at least one of the cold-cathode and the hot-cathode fluorescent tube.

3. The backlight device according to claim 1, wherein the modulating device includes:

a frequency hopping data generator configured to generate a pseudo-randomly changed voltage; and an oscillator configured to generate a high frequency voltage having frequencies pseudo-randomly changed by the pseudo-randomly changed voltage from the frequency hopping data generator to light at least one of the cold-cathode and the hot-cathode fluorescent tube.

4. The backlight device according to claim 1, wherein the power supply device further comprises a booster circuit electrically connected to the light emitting source and for boosting the pseudo-randomized and the PWM-modulated high-frequency voltage to the high-frequency power supply to light at least one of the cold-cathode and the hot-cathode fluorescent tube.

5. A backlight device for a liquid crystal display (LCD), said backlight device comprising:

a power supply generating device configured to generate a high frequency power supply; and a light-emitting source that includes at least one of a cold-cathode and a hot-cathode fluorescent tube that utilizes the high-frequency power supply from the power supply generating device;

wherein the power supply generating device includes, a pulse width modulation (PWM) controller configured to generate a PWM control signal; and a modulating device configured to receive the PWM control signal to generate a PWM-modulated high frequency voltage to adjust a brightness of the light-emitting source, wherein the modulating device includes:

an oscillator for generating a high-frequency voltage;

a phase modulation data generator for generating a pseudo-random code;

a modulator for generating a pseudo-randomly changed high-frequency voltage having phases and/or frequencies pseudo-randomly changed per one wave of the high-frequency voltage from the oscillator by receiving the pseudo random code from the phase modulation data generator; and a PWM circuit for generating the pseudo-randomized and the PWM-modulated high-frequency voltage as the PWM-modulated high-frequency voltage by PWM-modulating the pseudo-randomly changed high-frequency voltage from the modulator using the PWM control signal from the PWM controller.

6. The backlight device according to claim 1, further comprising an LCD located adjacent to the light emitting source.

7. The backlight device according to claim 1, wherein the PWM control signal has frequencies near 38 kHz.

8. A method for backlighting a liquid crystal display (LCD) using a backlighting device, said method comprising:

providing a light-emitting source that utilizes a high-frequency power supply and has a brightness attribute;

generating the high frequency power supply, said generating comprising:

generating a pulse width modulation (PWM) control signal;

modulating a high-frequency voltage by receiving the PWM control signal to generate a PWM-modulated high-frequency voltage to adjust the brightness attribute of the light-emitting source;

wherein the modulating comprises generating a pseudo-randomized and PWM-modulated high frequency voltage having a frequency component of pseudo-randomized variations when the PWM control signal is in an active state as the PWM-modulated high-frequency voltage so as to lower an infrared energy generated from the backlight device to a level that exerts little or no influence on receiving of an infrared remote control signal having a predetermined frequency band, and wherein the generating further comprises boosting the pseudo-randomized and the PWM-modulated high frequency voltage as the PWM-modulated high-frequency voltage to the high-frequency power supply.

9. The method of claim 8, wherein the modulating includes generating pseudo-randomly changed codes, and changing pseudo-randomly a combination of frequencies of the high-frequency voltage with the pseudo-randomly changed codes to light at least one of the cold-cathode and the hot-cathode fluorescent tube.

10. The method of claim 8, wherein the modulating includes generating pseudo-randomly changed codes, and pseudo-randomly frequency-hopping the high-frequency voltage with the pseudo-randomly changed codes to light at least one of the cold-cathode and the hot-cathode fluorescent tube.

* * * * *